US011427437B2

(12) United States Patent
Romo et al.

(10) Patent No.: US 11,427,437 B2
(45) Date of Patent: Aug. 30, 2022

(54) OVERSPEED SAFELY BRAKE

(71) Applicant: SafeWorks, LLC, Tukwila, WA (US)

(72) Inventors: David Arevalo Romo, Bonney Lake, WA (US); Gregory Scott McDonald, Renton, WA (US)

(73) Assignee: SafeWorks, LLC, Tukwila, WA (US)

( * ) Notice: Subject to any disclaimer, the term of this patent is extended or adjusted under 35 U.S.C. 154(b) by 37 days.

(21) Appl. No.: 16/740,334

(22) Filed: Jan. 10, 2020

(65) Prior Publication Data

US 2020/0223664 A1 Jul. 16, 2020

Related U.S. Application Data

(60) Provisional application No. 62/790,903, filed on Jan. 10, 2019.

(51) Int. Cl.
*B66B 5/18* (2006.01)
*B66B 5/24* (2006.01)

(52) U.S. Cl.
CPC . *B66B 5/18* (2013.01); *B66B 5/24* (2013.01)

(58) Field of Classification Search
CPC .... B66B 5/18; B66B 5/24; B66B 5/04; E04G 3/28
See application file for complete search history.

(56) References Cited

U.S. PATENT DOCUMENTS 3,386,530 A * 6/1968 Thompson ..... B66B 5/24 182/112
3,586,125 A * 6/1971 Durand ..... B66B 5/20 182/92
4,029,177 A * 6/1977 Fiss ..... B66B 5/044 187/374
4,106,753 A * 8/1978 Cavalieri ..... B66B 5/24 182/112
4,254,941 A * 3/1981 Tanson ..... B66D 5/16 188/188
4,821,842 A * 4/1989 Cavalieri ..... B66D 1/54 182/144
2007/0007083 A1* 1/2007 Husmann ..... B66B 5/20 187/366
2015/0122592 A1* 5/2015 Zhu ..... B66B 7/085 188/65.1
2019/0168998 A1* 6/2019 Rivero ..... B66B 5/185

FOREIGN PATENT DOCUMENTS

DE 202011001304 U1 * 3/2011 ..... A62B 1/14
DE 202013008854 U1 * 1/2015
RU 178481 U1 * 4/2018 ..... A62B 1/14

OTHER PUBLICATIONS

Freight Lift, Apr. 4, 2018, Machine translation of RU 178481 U1 (Year: 2018).*

* cited by examiner

*Primary Examiner* — Michael R Mansen
*Assistant Examiner* — Michelle M Lantrip
(74) *Attorney, Agent, or Firm* — BakerHostetler

(57) ABSTRACT

An overspeed brake system is described to engage a safety cable and subsequent brake system once a threshold speed is reached. An overspeed safety kit may be installed on an elevator system or lift car, to identify a threshold speed and engage a brake lever to activate a braking system. One or more brake engagement devices may be applied to limit the force on the brake lever during a fall, thereby preventing potential damage to brake components, while cushioning the deceleration.

19 Claims, 7 Drawing Sheets

OVERSPEED SAFELY BRAKE

CROSS REFERENCE TO RELATED APPLICATION

This application claims benefit under 35 U.S.C. § 119(e) of Provisional U.S. patent application No. 62/790,903, filed Jan. 10, 2019, the contents of which are incorporated herein by reference in their entirety.

TECHNICAL FIELD

This disclosure relates to safety brake mechanisms, and more specifically to overspeed brake mechanisms for use with elevators.

BACKGROUND

Elevators and lift cars move people and objects vertically along a track, for example between floors or platforms of a building or other structure. These lift systems may be suspended and moved by one or more cables driven by a motor, such as a hydraulic, electric or other type of motor. Brake systems mechanically connected to the one or more cables may be configured to engage the cables to slow and/or stop a movement of the lift car.

Safety mechanisms may be installed on elevators and lift car systems as back-ups to ensure that brakes engage in the event of a cable failure, brake system failure, or other event, which may cause the lift car to fall. While such safety mechanisms may assist in ensuring that lift cars do not remain in a free-fall state, the sudden deceleration following an unexpected drop may be damaging to both the lift car system and individuals within the lift car.

In addition, given that acceleration will increase during a fall until the gravitational acceleration is reached, the force required to stop the fall will increase over the duration of the fall. Thus, the longer the fall, the greater potential for damage on braking system and other lift components, which must absorb such forces. This impact may be uncomfortable and even harmful to individuals on the lift cars, who must absorb the force from a sudden stop. Safety systems have yet to address potential damage from secondary braking mechanisms, and methods for force reduction, which could be beneficial in prolonging functional lift car systems and increasing comfort during such emergency braking situations.

SUMMARY

Illustrative examples of the present disclosure include, without limitation, methods, structures, and systems. In an embodiment, an overspeed brake system comprises a safety kit to engage a safety cable when a threshold speed is reached, and the engagement of the safety cable slows or stops a downward movement of a lift car. The overspeed brake system further comprises a shaft connected to the safety kit, a guide to maintain a position of the shaft relative to the lift car, and a brake engagement device connected to the shaft and a brake lever, configured to reduce force on the brake lever during an engagement of the safety cable by the safety kit. The brake lever may be configured to engage a primary brake system to slow or stop movement of the lift car, or other means for braking.

In embodiments, the shaft may be a telescoping shaft comprising an outer rail and inner rail that are slidably movable to adjust a length of the telescoping shaft. The brake engagement device may comprise a connecting element linking the outer and inner rails, as well as a shear pin linking the outer/inner rails and connecting elements so as to prevent an adjustment to the length of the telescoping shaft until a breaking point of the shear pin is met. In another embodiment, the brake engagement device may comprise a rod and spring positioned within one or more brackets attached to the vertical shaft. The spring may have a compression force of at least 70 pounds, as an example. The brake engagement devices may allow the lift car to drop a predetermined distance prior to engagement of the primary brake system. In various embodiments, the safety kit may be configured to receive one or more cables (e.g., 8, 9, 10 mm cables), and an overspeed governor system may be utilized to identify the threshold speed and engage the wire cable. The safety kit may further comprise one or more manual controls to activate, reset, lock, unlock, or test the safety kit.

Other features of the methods, structures, and systems are described below. The features, functions, and advantages can be achieved independently in various examples or may be combined in yet other examples, further details of which can be seen with reference to the following description and drawings.

BRIEF DESCRIPTION OF THE DRAWINGS

A more detailed understanding may be had from the following description, given by way of example in conjunction with the accompanying drawings wherein:

FIG. 2B illustrates another rear cross-sectional view of the safety kit, including the cable engagement mechanisms.

DETAILED DESCRIPTION

Various aspects of the present disclosure as described herein are generally directed to an overspeed safety brake for lift cars, cabs, and other elevator systems.

Figure 1:
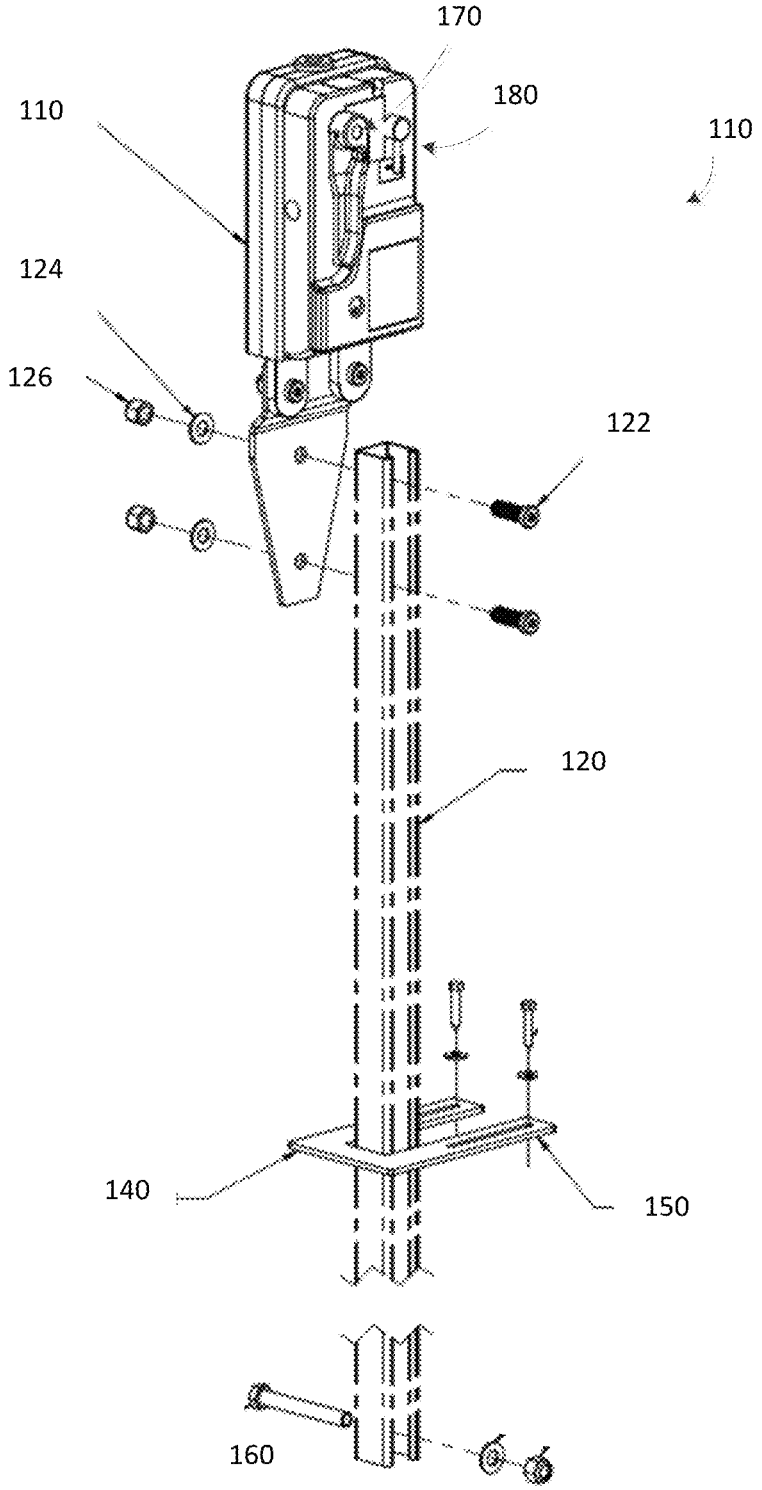
FIG. 1 illustrates an overspeed brake system.

FIG. 1 is a perspective view of an overspeed safety system 100, which may be installed on an elevator system. An overspeed safety kit 110, attaches to a top portion of shaft 120, and is secured using at least one attachment, such as one or more screws 122, washers 124, and nuts 126. The safety kit is configured to receive a safety cable through an input on the upper portion of safety kit 110, and the cable exits through the bottom of the safety kit, along the inner portion of the shaft 120. In embodiments, the cable may comprise a diameter of 8 mm, 9 mm, or 10 mm, for example, depending upon the weight of the elevator system, and/or the desired maximum load for the elevator system to support. In other embodiments, multiple cables, cable types, e.g., wire cables, and different cable sizes may be utilized.

A guide 140 may be added to ensure the shaft 120 remains in its proper position during movements of the elevator system. Attachments 150 may be secured to an object on a platform, or even the platform itself, to keep the shaft in a stable position, and prevent major movement of the shaft 120. It will be appreciated that the guide design is not limited to the U-shaped bar depicted in FIG. 1. As illustrated in FIGS. 3-6 and discussed herein, the guide may comprise any of a number of designs that partially or fully surround the shaft 120 and may attach using different methods. Below the shaft is an attachment 160 that can connect to a brake lever system, as further discussed herein. In other embodiments, the attachment 160 may assist in securing the shaft to a platform or other portion of the elevator system.

The overspeed safety kit 110 is a primary engagement device to engage a brake lever to set the elevator system brakes when the elevator car reaches a certain speed, e.g., during a fall of an elevator car. The safety kit 110 detects a speed of the elevator car, and when a threshold speed is detected, e.g., a predetermined amount greater than the elevator car's intended moving speed, the safety kit 110 engages the safety cable to set the elevator brakes through the use of a brake lever. As described in more detail with respect to FIGS. 2-4, the overspeed safety kit may identify a threshold speed based on the movement of a cable through the safety kit as the platform is vertically moved, and engage the safety cable to stop a downward movement. In embodiments, the safety cable engagement may subsequently trigger a mechanical reaction in the brake system to engage the brakes to secure one or more cables associated with the lift car, and stop the lift from falling to the ground.

The safety kit 110 may utilize a governor system, for example, to engage the cable and brake lever when the car reaches the threshold speed. In other embodiments, a measured movement of the cable through the safety kit 110 may assist in determining that the threshold speed has been met. The threshold speed for the overspeed safety kit may vary depending on safety requirements and desired parameters. It will also be appreciated that any of a variety of physical, mechanical, and electrical systems may be provided to detect that a threshold speed has been met by the elevator car, and activate the brake system.

The safety kit may also provide for manual activation to allow regular testing and verification that the brakes are engaging as designed. As illustrated in FIG. 1, a first lever 170 and second lever 180 are provided on the safety kit 110 to manually activate and reset the safety kit. In one example, the first lever 170 may be engaged to unlock the safety kit, i.e., disengage the safety cable, while second lever 180 may be engaged to lock the safety kit, i.e., engaging the cable. These features may also be utilized for testing purposes, to ensure that the safety kit 110 is functional, or for additional safety measures when the car is stable. In one embodiment, an upward movement of the elevator car unlocks the safety kit's engagement with the cable and resets the safety kit for engagement in the event of a fall, where the threshold speed is met.

In embodiments, the safety kit may be set at a particular height above the elevator car platform. For example, the safety kit may be set at 42" above the platform, or a height that does not exceed the height of guardrails. In these or other embodiments, the height may be selected to allow the working area on the platform to be clear, and/or to allow space for the platform rails to be set.

Figure 2A:
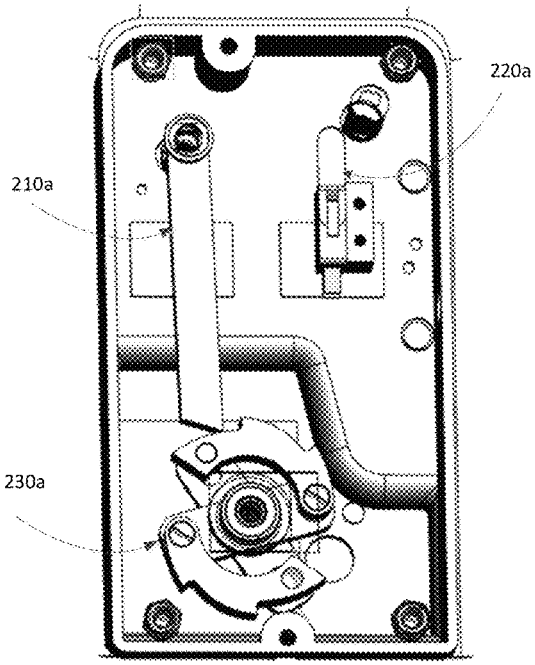
FIGS. 2A and 2B illustrates a rear cross-sectional view of the safety kit, including a manual activation mechanism.
Figure 2B:
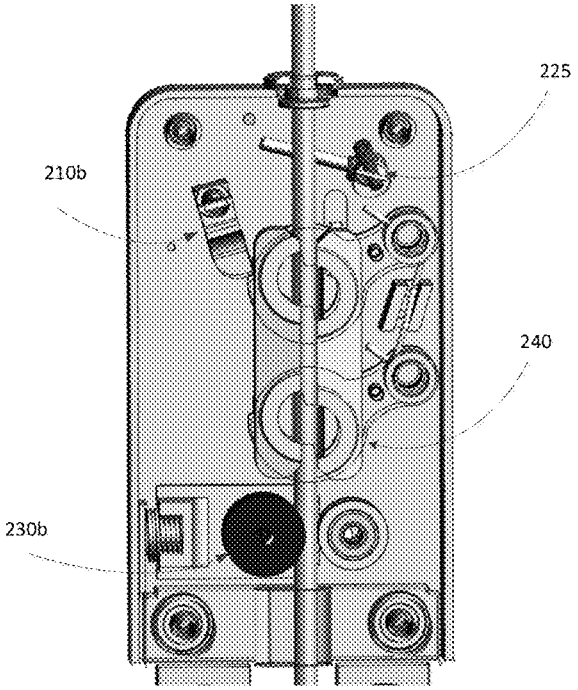

FIGS. 2A and 2B depict cross-sectional rear views of the overspeed safety kit as described herein. FIG. 2A illustrates mechanism behind a manual engagement of the manual lock/unlock levers of the safety kit, while FIG. 2B more clearly depicts a cable engagement mechanism. From this perspective, FIG. 2A comprises a layer beneath FIG. 2B. With reference to both FIGS. 2A-2B., gear 230 is directly associated with the movement of the safety cable, and by extension, the vertical movement of the lift car. The gear may be positioned to rotate as the safety cable passes in either direction, up or down. In one embodiment, the gear 230 may be configured to rotate in one direction while the lift car is going up (i.e., the cable is moving downwards through the safety kit) and in the opposite direction during a downward movement of the car. When the lever 210, is engaged (as depicted), gear 230 is prevented from rotating in the opposite direction. That is, the gear is locked during a downward movement of the lift car. The gear 230 is in turn, directly linked to an engagement of the cable through engagement mechanism 240. When the engagement mechanism 240 engages lever 210 and activates item 240 to engage wire rope, the engagement mechanism 240, clamps onto the cable to prevent additional movement. This may trigger and/or assist the brake system, as disclosed herein, and prevent the lift car from moving downward.

Similarly, the unlock lever 220 resets the overspeed safety kit, in order to allow movement of the car in both directions. During an engagement of the unlock lever, pin 225 is reset, which triggers a release of the engagement mechanism 240, and allows normal operation. Then, during a subsequent overspeed event, such as fall, or any event which exceed the threshold speed, the lock mechanism may become automatically engaged, and thus trigger an engagement of the cable engagement mechanism, as described above. It will be appreciated that this is only one example of a safety kit and its lock/unlock mechanisms. Overspeed safety kits are not limited to the depicted mechanical embodiment, and the present figures are provided for illustrative purposes only. They are not meant to be limiting in any way.

Figure 3:
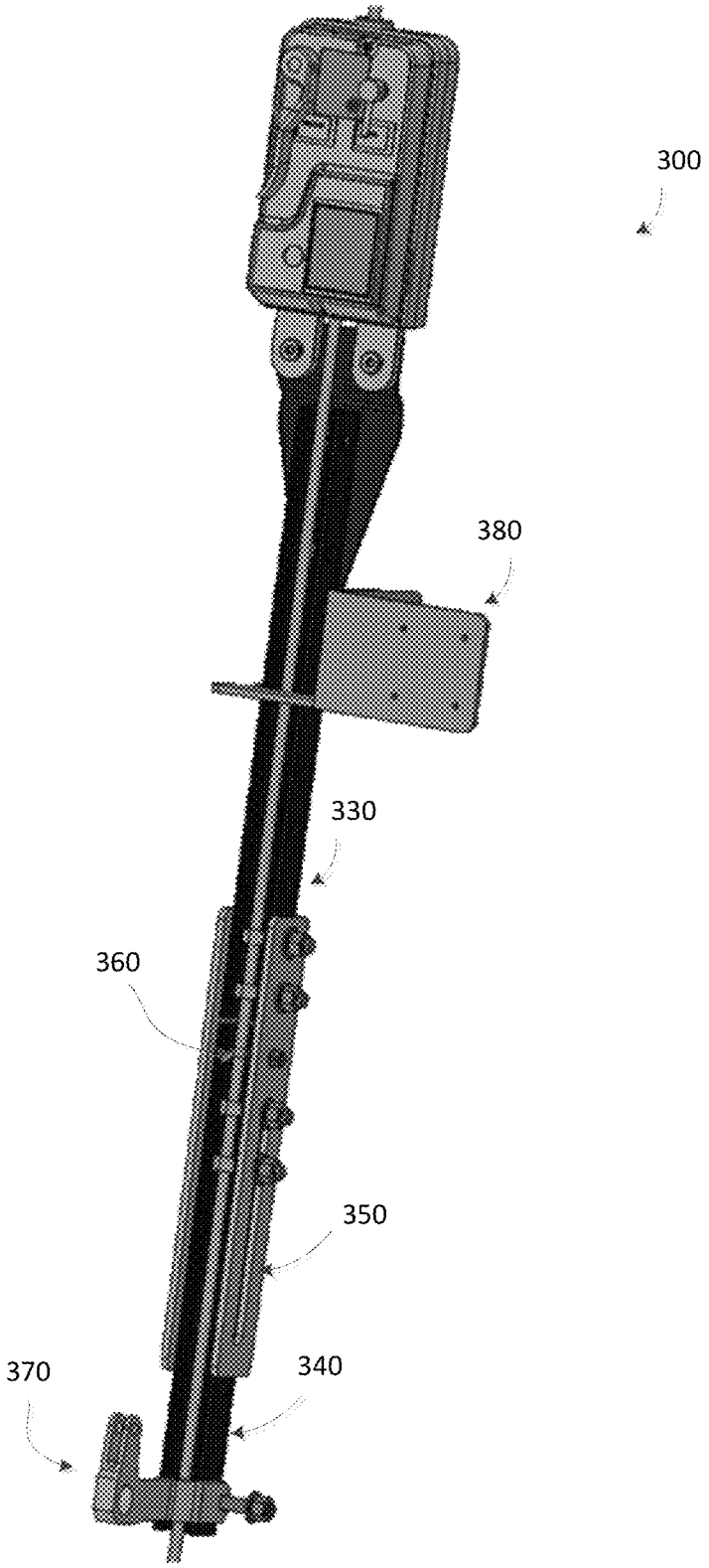
FIG. 3 is a perspective view of an overspeed brake system comprising a secondary engagement device.

FIG. 3 illustrates another configuration of an overspeed safety system 300, having a modified engagement mechanism to limit excessive forces on the brake lever and overspeed safety components. As discussed further herein, the modified engagement device may (i) limit excessive force applied to the brake lever; (ii) engage a lift car brake system in the event that a primary engagement device fails; and (iii) cushion the braking impact during a fall.

In an embodiment, the engagement mechanism comprises a telescoping shaft and shear pin mechanism. The telescoping shaft comprises an outer rail 330 and an inner rail 340 that are slidably moveable to lengthen or shorten the telescoping shaft. The outer and inner rails are linked together by a connecting element 350 that uses one or more fasteners, e.g., a bolt, screw, or the like, to connect the outer rail and the inner rail, and enable the sliding interaction between rails to lengthen and shorten the shaft. In an embodiment, a top end of the connecting element may attach to the outer rail 330, and a bottom end of the connecting element may attach to inner rail 340. In other embodiments, the top end may be connected to the inner shaft, and the bottom end may be connected to the outer shaft, depending on the configuration of the telescoping shaft. The connecting element allows the outer and inner rails to slidably move in relation to one another to length or shorten the shaft. In an example, as illustrated in FIG. 3, the bottom end of the connecting element 350 provides one or more openings to allow the inner rail 340 to slidably move in relation to the outer rail, in order to shorten the length of the telescoping shaft.

It will also be appreciated that the connecting element 350 and its method of attachment to the telescoping shaft is not limited to the embodiments described above. The connecting element 350 may comprise any number of shapes, sizes, means for connecting the telescoping shaft sections, methods of attachment, and means for enabling movement of the telescoping shaft. Similarly, the telescoping shaft may comprise any number of styles, sizes, stroke length, and designs in accordance with embodiments described herein.

A shear pin 360 prevents lengthening, and shortening of the telescoping shaft, until enough force is applied to break the shear pin. The strength of the shear pin may be determined based on a desired cushioning force and/or a force deemed to be an excessive load for the brake lever 370.

As mentioned above, the engagement mechanism can limit excessive force applied to the brake lever. A heavy load on the elevator system, and/or a long free fall period may place excessive force on brake lever 370 when engaging the brake system. The engagement mechanism limits damage to the brake lever and/or brake system, by allowing the lower portion of the telescoping shaft, and consequently the shear pin 360, to absorb a portion of the excessive force. The amount of force able to be absorbed depends on the breaking point of the shear pin. Accordingly, a variety of shear pin types, sizes and strengths may be utilized in one or more embodiments.

FIG. 3 further illustrates a magnetic guide 380 to stabilize the shaft during movement of the elevator system, similar to guide 140 in FIG. 1. In an embodiment, the magnetic guide 380 magnetically attaches a portion of the lift car, such as a rail or vertical support element (see FIG. 4). In this manner, the magnetic guide allows for a secure attachment to the lift car system without requiring any modifications to the lift car itself. For example, no screws or holes need to be added to the elevator system, and no additional hardware need be installed. The guide 380 may fully surround the shaft and cable, while an attachment portion comprising one or more magnets secure the guide 380 to the elevator car. In embodiments, the magnets have a predetermined holding force, for example, at least 50 pounds. It will be appreciated that configurations for the guide are not limited to a magnetic attachment, and may comprise any number of configurations to provide a secure attachment to an elevator car, and stabilize the shaft and cable during movement.

Figure 4:
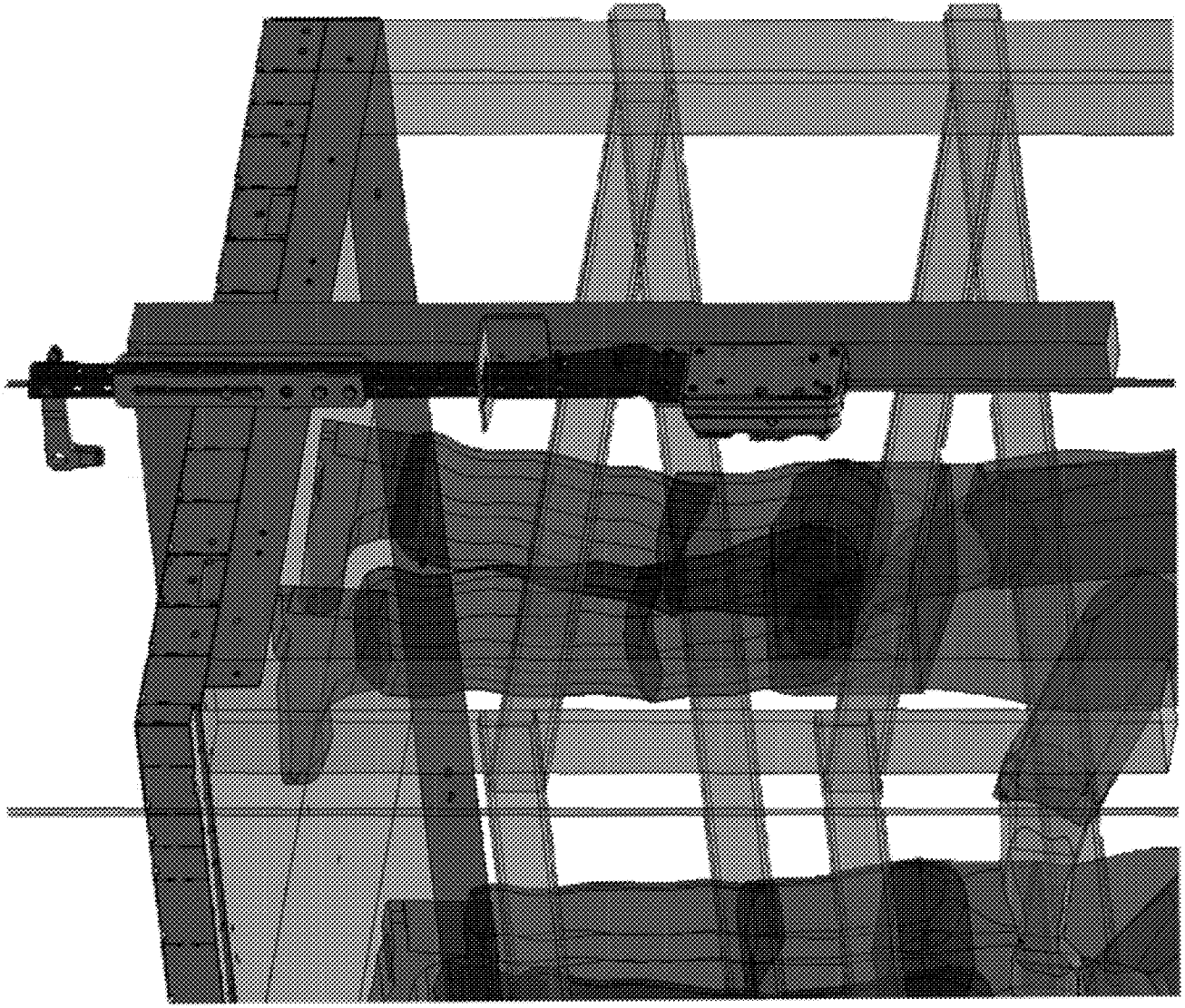
FIG. 4 illustrates an overspeed brake system installed on an elevator car.

FIG. 4 depicts an overspeed braking system installed on an elevator car. The magnetic guide is attached to a vertical support column on the elevator car, with the safety kit easily accessible and usable for an individual to operate. The brake lever is located beneath the car and positioned to engage a brake system (not pictured). While multiple cables may be utilized to support the elevator car, the overspeed brake system need only be installed on a single cable.

Figure 5:
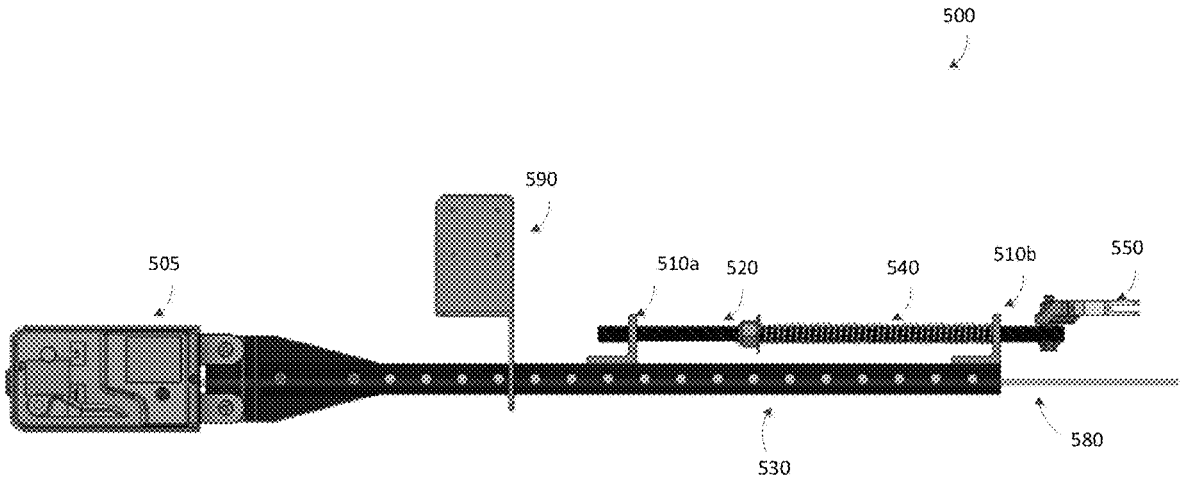
FIG. 5 illustrates another embodiment of an overspeed brake system comprising a secondary engagement device.

FIG. 5 illustrates another embodiment of an overspeed brake system 500 comprising a brake engagement mechanism to limit excessive forces applied to the brake lever. In this embodiment, the engagement mechanism comprises a spring element connected to the brake lever. The spring element acts similarly to the telescoping shaft and shear pin mechanism, in that it may limit excessive force applied to the brake lever, engage the elevator brakes in the event that a primary brake engagement fails, and cushion the braking impact during a fall.

In the depicted embodiment, two L-shaped brackets 510*a*, 510*b* are attached to shaft 530. A rod 520 is placed in a vertical position between the brackets 510, and a brake lever 550 is attached to the bottom end of the rod 520. Spring 540 surrounds a middle portion of the rod 520 between the brackets 510, with an upper end secured to the rod by a fastener. The rod 520 is vertically movable through brackets 510, and the spring 540 resists a downward movement of the rod 520 relative to shaft 530.

During a fall, when the safety kit engages the wire cable, the rod 520 and the attached brake lever 550 continue moving downwards. The spring 540 slows the downward movement of rod 520 thus cushioning the impact of the brake lever 550 in the subsequent braking system. The cushioning effect of the spring during a braking event in a fall is based on its spring constant and length. Typically, when the brakes are engaged, e.g., following a free fall, the impact of a sudden stop may be uncomfortable or even harmful to individuals within the elevator car. Similar to the telescoping shaft and shear pin mechanism, the spring may absorb some of that impact to create a more comfortable stop, while also reducing force and potential damage to the brake lever 550 and subsequent braking components. In an embodiment, the spring's compression force may be, for example, at least 70 lbs or another predetermined force, over a 6-7 inch compression. In another example, the compression force absorbed by the brake engagement device may be between 70-120 pounds. In some examples, the brake engagement device prevents the lift car from dropping more than six to seven inches before engaging the brake system. It will also be appreciated, however, that the spring's compression force is not limited to that range and the type and strength of the spring may vary depending upon safety requirements, the weight of the elevator car, and other considerations. Therefore, depending on the spring type, size, length, and other physical factors, the lift car will continue falling for a particular distance after engagement of the safety kit, before the primary braking system engages through the brake lever. Accordingly, this may cushion the fall and make the experience more comfortable for individuals in the lift car, and limit wear and tear on braking components.

Figure 6:
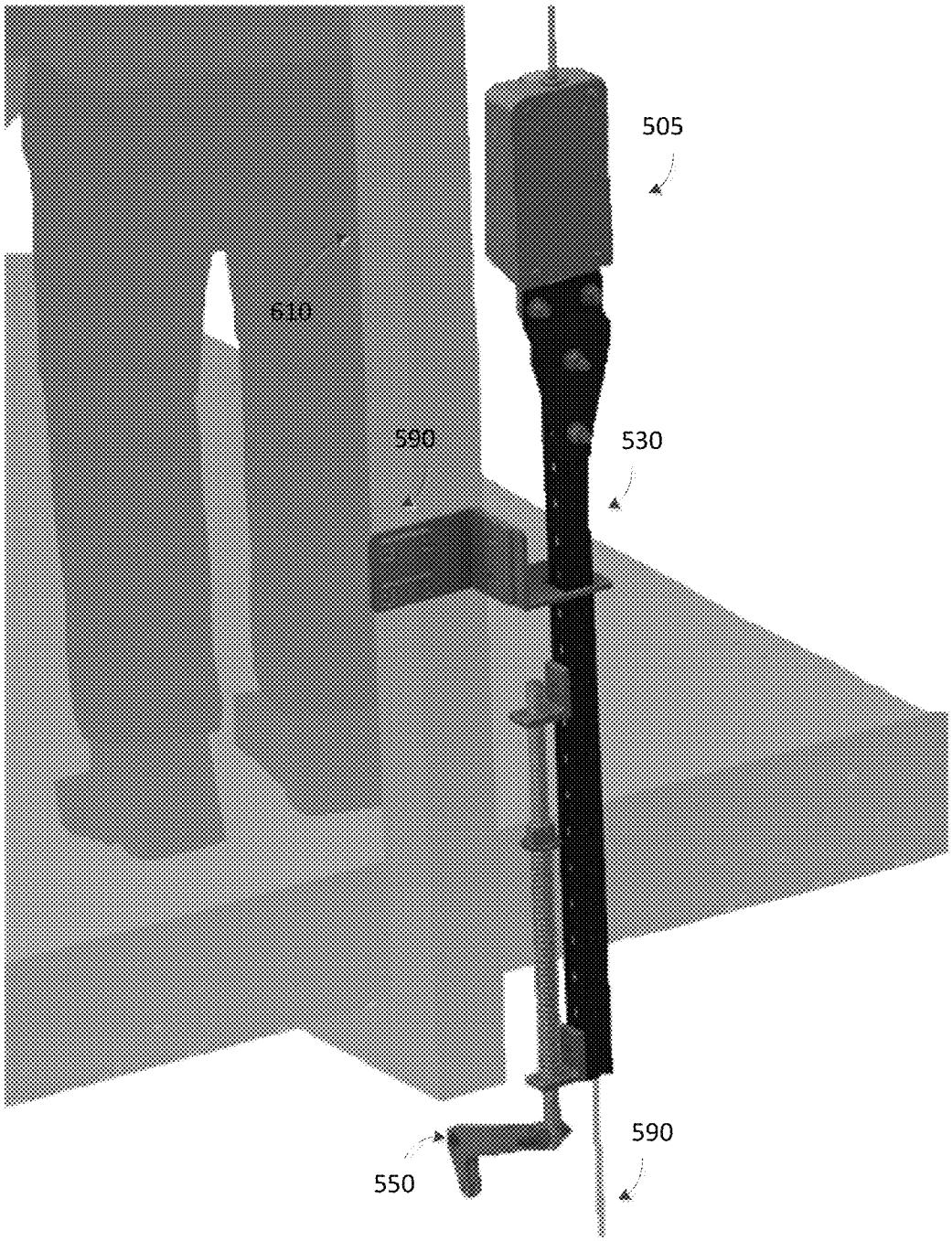
FIG. 6 illustrates a back view of an overspeed brake system installed on an elevator car.

FIG. 6 depicts a back view of an overspeed brake system installed on an elevator car. The overspeed safety kit 505 attaches to shaft 530, and receives the wire cable 580, which travels downward along the shaft. The magnetic guide 590, attaches to a vertical support on the elevator car 610, and holds the shaft in place. The magnetic guide may comprise two L-shaped brackets, with a first bracket further comprising two or more magnets to attach to a vertical support column or other element of the elevator car, and the second bracket comprises and opening through which the shaft may be positioned. The magnetic guide does not support or bear any weight of the safety kit 505, shaft 530, and other elements, but merely acts as a positional guide to ensure that the system remains in the proper position and orientation during movements of the elevator car.

The brake lever 550 engages a brake system (not depicted) immediately after the safety kit 505 engages the cable. The rod and spring elements attach to a bottom portion of shaft 530, and absorbs a portion of the downward force, which would be exerted on the brake lever 550 when the safety kit is activated. This may allow the elevator car to travel a distance, e.g., 6-7 inches or a distance less than or equal to the length of the spring, before coming to a stop. In this manner, the rod and spring element assists in cushioning an abrupt stop of the elevator car.

Figure 7:
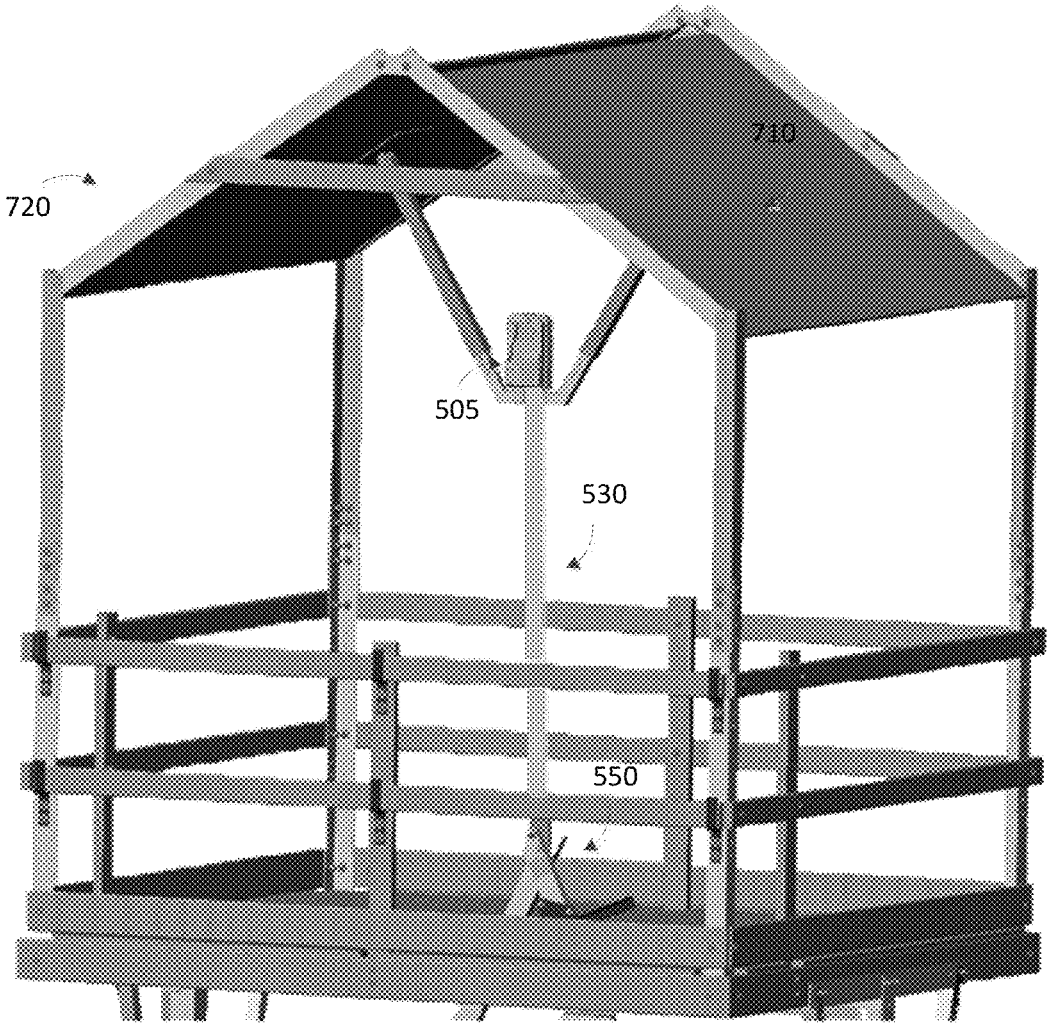
FIG. 7 illustrates another embodiment of an overspeed brake system installed on an elevator car.

FIG. 7 illustrates an additional embodiment of the overspeed brake system, in which the overspeed is connected to an upper portion 710, e.g., a roof or canopy, of a lift car 720. In the depicted embodiment, a vertical shaft 530 is connected to a brake lever 550 positioned on a bottom portion of lift car 720. In other configurations and embodiments, the overspeed safety kit 505 may be mounted or positioned in various locations on or within the lift car, including but not limited to mounting on top of the roof or canopy, on one or more support shafts, guard rails, on a lower portion of the lift car, and the like. The location of the safety kit 505 may be chosen based on accessibility, e.g., at a position easily accessible by one or more operators or riders of the lift car. The location may also improve accessibility for service and inspection operations. In various examples, the positioning of the safety kit 505 will not affect the use, operation, or function of the overspeed safety kit 505, which will operate substantially as described herein.

In general, the various components and processes described above may be used independently of one another, or may be combined in different ways. All possible combinations and sub-combinations are intended to fall within the scope of this disclosure. The example systems and components described herein may be configured differently than described. For example, elements may be added to, removed from, or rearranged compared to the disclosed examples.

While different figures may represent alternate embodiments, identical element numbers used in different figures are intended to represent similar elements. Additionally, although certain examples or illustrative examples have been described, these examples have been presented by way of example only, and are not intended to limit the scope of the subject matter disclosed herein. Indeed, the novel methods and systems described herein may be embodied in a variety of other forms. The accompanying claims and their equivalents are intended to cover such forms or modifications as would fall within the scope and spirit of certain subject matter disclosed herein.

What is claimed:

1. An overspeed brake system comprising:

a safety kit configured to engage a safety cable to slow a downward movement of a lift car when a threshold speed is reached;

a vertical shaft connected to and positioned beneath the overspeed safety kit, wherein the safety cable passes through the safety kit and along the vertical shaft;

a guide maintaining a position of the vertical shaft relative to the lift car, wherein the guide at least partially surrounds the safety cable and a circumference of the vertical shaft; and a brake engagement device connected to the vertical shaft and a brake lever, wherein, upon engagement of the safety kit and the safety cable, the brake engagement device causes the brake lever to engage a brake system to stop the downward movement of the lift car, and wherein the brake engagement device reduces a force on the brake lever during an engagement of the brake system.

2. The system of claim 1, wherein the vertical shaft is a telescoping shaft comprising an outer rail and an inner rail, which are slidably movable to adjust a length of the telescoping shaft.

3. The system of claim 2, wherein the brake engagement device comprises a connecting element linking the outer rail and the inner rail of the vertical shaft via a shear pin, wherein the shear pin, prevents an adjustment to the length of the telescoping shaft until a breaking point of the shear pin is met.

4. The system of claim 1, wherein the brake engagement device comprises a rod and spring positioned within one or more brackets attached to the vertical shaft.

5. The system of claim 4, wherein the spring has a compression force of 70-120 pounds.

6. The system of claim 1, wherein during a fall, the brake engagement device prevents the lift car from dropping more than six to seven inches before engaging the brake system.

7. The system of claim 1, wherein the guide magnetically attaches to the lift car, and partially or fully surrounds the vertical shaft.

8. The system of claim 1, wherein the safety cable is 8, 9, or 10 mm in diameter.

9. The system of claim 1, wherein the safety kit comprises an overspeed governor to identify the threshold speed and engage the safety cable.

10. The system of claim 1, wherein the safety kit further comprises one or more controls for manually activating the safety kit.

11. The system of claim 1, wherein the safety kit is configured to disengage the safety cable upon an upward movement of the lift car.

12. An overspeed braking method comprising:

guiding a safety cable along a vertical path using a safety kit and a vertical shaft connected to and positioned beneath the safety kit, wherein the safety cable passes through the safety kit and along the vertical shaft;

engaging the safety cable to slow a downward movement of a lift car when the safety kit detects a threshold speed, wherein the safety kit configured to engage the safety cable;

maintaining a position of the vertical shaft relative to the lift car using a guide that at least partially surrounds the safety cable and a circumference of the vertical shaft and upon engagement of the safety cable, activating a brake engagement device connected to the vertical shaft, wherein the brake engagement device causes a brake lever to engage a brake system to stop the downward movement of the lift car, and wherein the brake engagement device reduces a force on the brake lever during an engagement of the brake system.

13. The method of claim 12, wherein the vertical shaft is a telescoping shaft comprising an outer rail and an inner rail.

14. The method of claim 13, further comprising linking an outer rail and an inner rail of the telescoping vertical shaft with a connecting element such that adjustments to the length of the vertical shaft is prevented until a breaking point of the connecting element is met.

15. The method of claim 12, wherein the guide magnetically attaches to the lift car.

16. The method of claim 12, wherein the brake engagement device engages a brake detection system such that the lift car drops no more than seven inches.

17. The method of claim 12, further comprising identifying the threshold speed for engaging the safety cable using an overspeed governor.

18. The method of claim 12, further comprising manually activating the safety kit to engage the safety cable.

19. The method of claim 12, further comprising disengaging the safety cable upon an upward movement of the lift car.

* * * * *